United States Patent [19]

Pauli

[11] 4,079,886

[45] Mar. 21, 1978

[54] DOUBLE PORTED EXPANSION VALVE

[75] Inventor: Jude A. Pauli, Florissant, Mo.

[73] Assignee: Emerson Electric Co., St. Louis, Mo.

[21] Appl. No.: 769,515

[22] Filed: Feb. 17, 1977

[51] Int. Cl.[2] ..... F16K 11/04

[52] U.S. Cl. ..... 236/92 B; 137/625.35; 137/625.36

[58] Field of Search ..... 137/625.36, 625.37, 137/625.35; 236/92 B

[56] References Cited

U.S. PATENT DOCUMENTS

| | | | |
|---|---|---|---|
| 1,275,831 | 8/1918 | Barrett | 137/625.36 |
| 2,709,451 | 5/1955 | La Bour | 137/625.35 |
| 2,771,248 | 11/1956 | Ehlke | 236/92 B |

*Primary Examiner*—Arnold Rosenthal

*Attorney, Agent, or Firm*—Polster, Polster and Lucchesi

[57] ABSTRACT

A double ported valve has structural features including an integral valve body construction which provides more consistent valve performance, longer valve life, and improved operating characteristics. The integral valve body eliminates the need for external sealing gaskets. Consequently, a consistent valve stroke can be maintained, thereby reducing variations in valve capacity in applicational use. The construction also permits the various valve components to be tested prior to final assembly. Compensation for variations discovered during test is accomplished by providing an external adjustment means in the valve. The adjustment means is positioned downstream of the outlet side of the valve so that short stroke valve operation is possible, with consequent reduction in the amount of valve packing required to seal a stem of the valve against leakage.

10 Claims, 2 Drawing Figures

DOUBLE PORTED EXPANSION VALVE

BACKGROUND OF THE INVENTION

This invention relates to double ported valves, and in particular, to a double ported valve finding application as a thermostatic controlled expansion valve in a refrigeration system. While the valve is described with particular emphasis to its use as an expansion valve, those skilled in the art will recognize the wider applicability of the inventive principles disclosed hereinafter.

Double ported valves frequently are used in refrigeration systems where capacity requirements of the systems exceed that which can be controlled by a valve with a single valve port. The thermostatically controlled valve is positioned in the refrigeration system to control system operation by modulating the amount of refrigerant passing through the valve restriction. That is, refrigeration systems generally include an evaporator, a compressor and a condenser. Refrigerant vapors drawn from the evaporator by the compressor are forced into the condenser, where the vapor liquifies. The liquid refrigerant then is returned to the evaporator through an expansion valve. Control of refrigerant input to the evaporator can be maintained by inserting a valve member in the restriction of the expansion valve and adjusting the valve member in response to a particular sensed condition. The modulating means often includes a temperature sensing diaphragm actuated valve member. The sensor is connected to one side of the diaphragm, while a spring is biased between the valve and the diaphragm on a second side of the diaphragm.

The prior art reveals a number of double ported valves useful in conjunction with refrigeration applications constructed in accordance with the general outline described above. For the most part, these valves have used a construction which requires gasketed joints at the interconnection of the thermostatic control element and the valve body. One disadvantage with a gasketed joint type construction is that such construction requires close tolerance control, resulting in high manufacturing costs. In addition, in field use, the gasketed joint is not as reliable as a welded, soldered, brazed or similar permanent connection, for example, in that gasket wear can affect valve operation adversely. Another disadvantage with prior art valves is that the spring used in connection with the thermostatic control often is placed adjacent the diaphragm, a valve stem of the valve passing through the spring to an operating interconnection with the diaphragm. With double ported valves, such an arrangement requires relatively complex means for sealing the valve stem against leakage, particularly if adjustment of the force exerted by the spring is a valve feature.

The invention described hereinafter overcomes these prior art deficiencies by providing a double ported valve arranged so that the valve may utilize an integrally constructed valve body. The valve body generally takes the form of an open ended cylindrical tube having an inlet and an outlet passing radially through the valve body. The thermostatic control device is mounted to one end of the valve body, while an adjustment means is mounted to the other end of the valve body. Because of the oppositely opposed relationship of the adjustment means and the thermostatic control means, a relatively short stroke valve design is possible, which permits a reduction in the amount of packing required to seal the valve stem against leakage.

One of the objects of this invention is to provide a double ported thermostatic controlled expansion valve having an integral valve body.

Another object of this invention is to provide a thermostatically controlled double ported valve with an integral valve body having the thermostatic control meand positioned on a first end of the valve body, and an adjustment means positioned on a second end of the valve body.

Another object of this invention is to provide a short stroke double ported thermostatically controlled valve.

Still another object of this invention is to provide a low cost, double ported valve.

Other objects of this invention will be apparent to those skilled in the art in light of the following description and accompanying drawings.

SUMMARY OF THE INVENTION

In accordance with this invention, generally stated, a double ported valve is provided with simplified structure including an integral valve body having an elongated tubular shape. A thermostatic responsive means closes a first end of the valve body. A valve stem is operatively connected to the thermostatic responsive means. A valve inlet and a valve outlet extend radially outwardly of the valve body and are axially spaced with respect to one another. A valve cage assembly is mounted in the axial opening of the valve body between the inlet and the outlet. The cage assembly has the valve stem passing through it and includes means for defining a first valve seat and a second valve seat surrounding the valve stem. A valve spool is attached to the valve stem and is at least partially carried within the cage assembly. The valve spool and valve seats define first and second valves within the valve body. A second end of the valve body has an adjustment assembly means mounted to it. The adjustment assembly means is operatively connected to the valve spool and permits external adjustment of valve operation. The opposed relationship of the thermostatic control means and the adjustment assembly means enables the valve of this invention to operate satisfactorily with relatively short valve stem stroke, and permits sealing of the valve stem at the cage assembly with relatively little valve packing material.

DESCRIPTION OF THE PREFERRED EMBODIMENT

Figure 1:
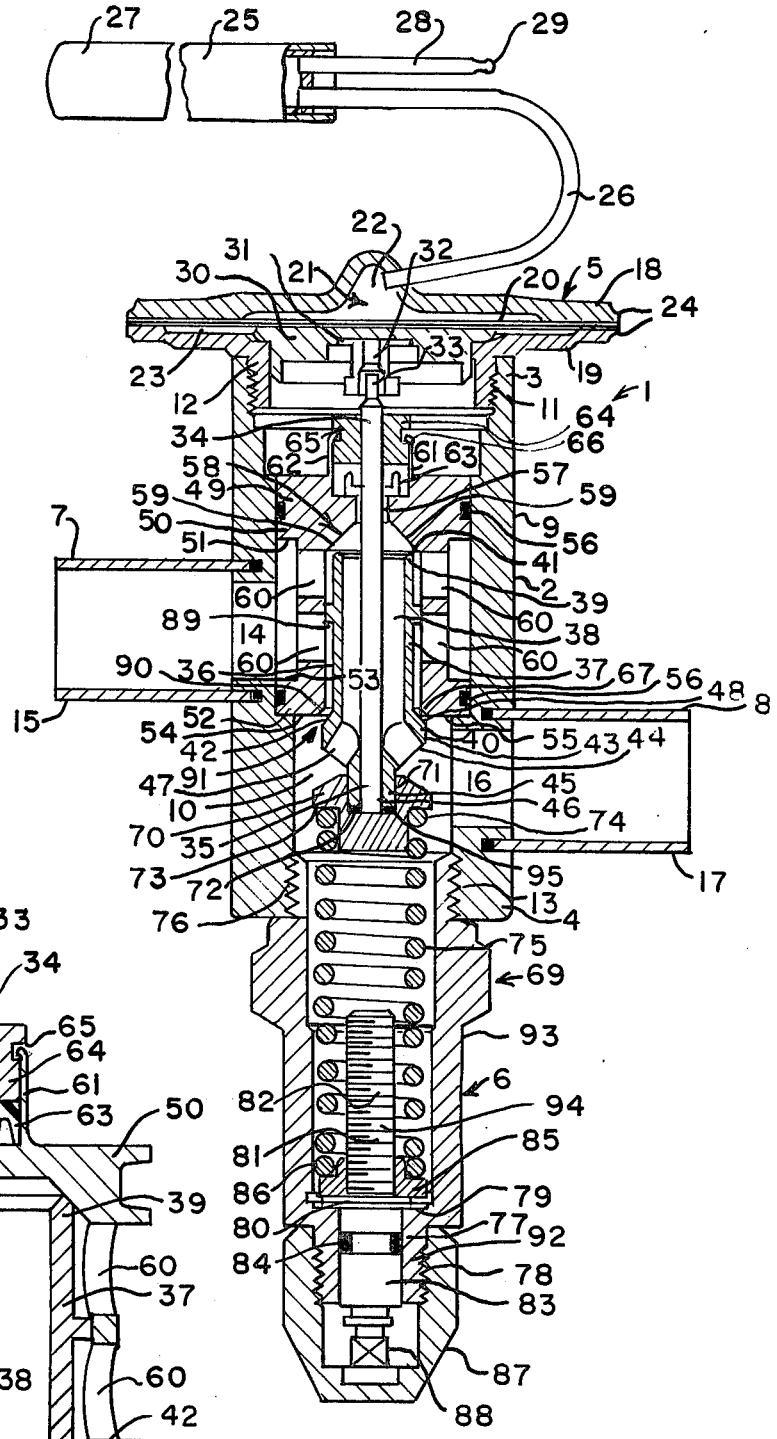
FIG. 1 is an enlarged sectional view of one illustrative embodiment of double ported valve of this invention, shown in its fully open operative position.

Referring now to FIG. 1, reference numeral 1 indicates one illustrative embodiment of double ported valve of this invention. The valve 1 includes a valve body 2 having a first end 3 and a second end 4. A thermostatic responsive means 5 is attached to the end 3 of the valve body, while an adjustment means 6 is attached to the end 4 thereof. An inlet 7 and an outlet 8 extend outwardly from the valve body 2.

Valve body 2 generally is a tubular structure having a side wall 9 of a predetermined thickness delimiting an axial opening 10 through the valve body. The valve body 2 is a unitary structure and has internal threads 11 along the opening 10 at the end 3, adapted to receive a connector 12 of the thermostatic responsive means 5. Likewise, the end 4 has threads 13 adapted to intermount the adjustment means 6 to the valve body 2. The side wall 9 also has a radial opening 14 in it, which communicates with the axial opening 10. A tube stub 15 is mounted about the opening 14 and with that opening defines the inlet 7 of the valve 1. An opening 16 also extends through the side wall 9, communicates with the axial opening 10 and with a tube stub 17 defines the outlet 8 of the valve 1. As shown in FIG. 1, the inlet 7 is spaced axially from the outlet 8 along the valve body 2. The tube stubs 15 and 17 permit insertion of the valve 1 in a variety of applications using conventional intermounting techniques.

Thermostatic means 5 is conventional and generally includes a first plate 18 and a second plate 19 having a movable diaphragm 20 mounted between the plates along the perimetrical edge of the diaphragm in accordance with well known techniques. The plates 18 and 19 define a valve chamber 21 which is divided by the diaphragm 20 into a chamber part 22 and a chamber part 23. The connector 12 is integrally formed with the plate 19 and the thermostatic means 5 is mounted as a unit to the valve body 2 thereby. The chamber part 22 of the valve chamber 21 is connected to a temperature responsive means 25 along a tube 26. Temperature responsive means 25 is conventional and generally includes a tubular body member 27 charged with a temperature responsive gas through a tube 28. After charging of the body member 27, the tube 28 is sealed along an end 29 of the tube. The gas contained in the body means 27, through expansion/contraction thereof in response to the temperature sensed by the means 25, exerts a varying force on the diaphragm 20, modulating valve position as later described in greater detail. Those skilled in the art will appreciate that an equalizer means may be connected to the chamber part 23 side of diaphragm 20. The equalizer means is used in setting the operating point of the valve, functioning primarily to simulate pressure drop through the evaporator coil of a refrigeration system.

An actuator 30 is operatively connected to the diaphragm 20 on the chamber part 23 side of the diaphragm. The actuator 30 has a central receptacle 31 formed in it, which is sized to receive a stem ball 32 in a conventional manner. The stem ball 32 is mounted to an end 33 of a valve stem 34. The stem ball 32 may be attached to the stem 34 in any convenient method. In the particular embodiment illustrated, the stem ball 32 is threadedly mounted to the valve stem 34, other attaching techniques, however, work well. The end 33 of the stem 34 may have a reduced diameter to facilitate its interconnection with the stem ball 32, if desired. The stem ball 32 abuts the actuator 30 in all positions of the valve 1. The stem 34 extends approximately along the centerline axis of the opening 10 in the valve body 2.

A second end 35 of the stem 34 has a spool assembly 36 mounted to it. Spool assembly 36 includes a tubular body part 37 having a central opening 38 extending between an end 39 of the body part 37 and a conic section 40, the conic section 40 being integrally formed with the body part 37. The end 39 defines a first valve means 41 for the valve 1, the operation of which is later described in greater detail.

Conic section 40 has an exterior wall 42 extending outwardly from the body part 37 of the spool assembly 36, a generally axial portion 43, and an inwardly extending wall 44 which meets a reduced diameter tubular part 45 of the spool assembly. Tubular part 45 has an end 95 which delimits the lower extremity of the spool assembly 36. The tubular part 45 has an opening 46 formed in it, which is sized to receive the end 35 of the valve stem 34 in a tight, friction fit. Typically, this joint also is brazed or welded to secure the spool assembly to the valve stem 34.

The wall 44 of conic section 40 has a plurality of openings 47 formed in it, which communicate with the opening 38 through the body 37 of the spool assembly 36. The wall 42 of conic section 41 defines a second valve means 48 for the valve 1, the operation of which is later described in greater detail.

A cage assembly 49 is mounted to the valve body 2 within the opening 10. Cage assembly 49 includes an upper annular flange member 50 mounted within the opening 10 so that a wall 51 of the flange 50 lies axially above the opening 14 of the inlet 7. The cage assembly 49 also has a lower flange 52 having a wall 53 positioned at or below the lower axial end of the opening 14 of the inlet 7, and a bottom wall 54 aligned axially at or above the opening 16 of the outlet 8, directions as just described being referenced to FIG. 1. The cage assembly 49 is press fit within the axial opening 10, which may have a lip 55 formed internally of the opening 10 to define a positive stop for cage assembly 49 placement. Conventional O-rings 56 are provided for sealing the opening 10 against fluid flow between the flanges 50 and 52 except along the regulated valve paths discussed below.

The flange 50 has a central opening 57 formed in it which receives and passes the valve stem 34 in a conventional manner. The wall 51 of the flange 50 also defines a first valve seat 59 about the opening 57, the seat 59 cooperating with the end 39 of the spool assembly 36 to delimit a first valve 58 for controlling fluid flow along a first flow path from the inlet 7, along a plurality of openings 60 in the cage assembly 49, through the valve 58 defined by the valve means 41 and valve seat 59, along the opening 38 in the body 37 of the spool assembly 36, and then to the outlet 17 through the openings 47 in the conic section 40 of the spool assembly.

As is observable in the drawings, the valve stem 34 passes through the central opening 57 of the flange 50, the valve seat 59 surrounding the stem 34 as it emerges from the flange 50. Some sealing arrangement about the stem is required in order to prevent leakage through the opening 57. Because of the opposed relationship of the thermostatic responsive means 5 and the adjustment means 6, sealing of the valve stem 34 is accomplished easily. The flange 50 has a hub 61 integrally formed with it. Hub 61 includes a wall 62 delimiting an axial opening sized both to receive and pass the stem 34, and to house a suitable valve packing 63 which is placed about the valve stem and held in place by a top plug 64. The plug 64 has a groove 65 formed about its perimeter and the wall 62 is deformed, along an end 66 of the wall, to mount the plug 64 to the hub 61. As may be observed in FIGS. 1 and 2, very little of the valve packing 63 is required to seal the valve stem 34 against leakage. The particular structure shown and described, permits use of a relatively short stroke for the valve 1, the full operation of the valve 1 being set out hereinafter.

The flange 52 of the cage assembly 49 defines a second valve seat 67 about an opening 90 in the bottom wall 54 of the flange, the seat 67 cooperating with the wall 42 of the conic section 40 to delimit a second valve 91 for controlling fluid flow along a path from the inlet 7, through the openings 60, along a passage 89 between the spool assembly 36 and the cage assembly 49, and through the valve 91 to the outlet 8.

Figure 2:
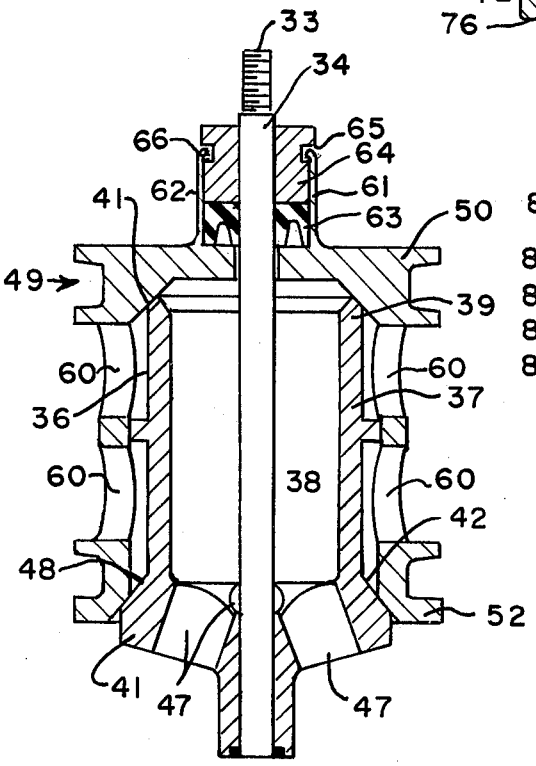
FIG. 2 is an enlarged sectional view of a cage assembly used in conjunction with the valve of FIG. 1 illustrating the closed position of the valve.

The valve stem 34 is movable between a first, closed position, illustrated in FIG. 2, and a second open position, shown in FIG. 1, by the operation of the temperature responsive means 25 acting upon the diaphragm 20. Increased pressure on the chamber 21 side of the diaphragm 20 causes downward movement of the valve stem, downward being referenced to FIG. 1, opening the valves 58 and 91. Both of the valves 58 and 91 open simultaneously with one another as the valve stem 34 moves downwardly.

The force required for stem 34 movement exerted by the temperature responsive means 25 is regulated by the adjustment means 6. Adjustment means 6 includes a stem adjustment assembly 69 having a spring guide 70 mounted to the tubular part 45 of the spool assembly 36 and consequently, to the associated end 35 of the valve stem 34, in a tight, friction fit. A closed bottom receptacle 71 is provided in the spring guide 70 for receiving the part 45-stem 34 structure. The end 95 of spool assembly 36 has a seal 72 mounted to it to prevent fluid leakage through the spring guide 70 at its interconnection with the tubular part 45 and valve stem 34. The spring guide 70 has an annular lip 73 formed in it, which seats an end 74 of a spring 75.

The adjustment means 6 includes a body 93 having an end 76 intermounted with the end 4 of the valve body 2. A second end 77 of the body 93 is reduced in diameter as indicated at 92. The reduced diameter portion 92 has threads 78 formed along an external wall, and has a lip 79 formed along an internal wall of the body 93. The lip 79 seats a flange 80 of an adjustment assembly 81. The assembly 81 includes a nut 94 having a construction wherein a threaded shank 82, the flange 80, and a head 83 are integrally formed with one another. A suitable O-ring 84 seals the valve 1 against leakage along the assembly 81. A self-threading washer 85 is mounted to the shank 82 of the assembly 81. The washer 85 seats a second end 86 of the spring 75.

A cap 87 is mounted to the end 77 of the body 93. The cap 87 functions primarily to protect the nut 94 against damage, and to prevent unauthorized regulation of the adjustment means 6. Rotation of an end 88 of the nut 94, as with a conventional wrench, causes movement of the washer 85 upwardly or downwardly along the shank 82. Upward movement of the washer 85 compresses the spring 75, which in turn exerts a greater force on the valve stem 34, requiring a higher pressure within the thermostatic responsive means 25 before the spool assembly 36 can be unseated from the valve seats 59 and 67. Downward movement of the washer 85 has the opposite affect.

As thus described, the valve 1 has an integral body 2 having a power assembly in the form of a diaphragm actuated thermostatic responsive device mounted on a first end of the valve body, and an adjustment means mounted in oppositely opposed relationship to the thermostatic responsive device on a second end of the valve body. This arrangement enables valve operation to occur with a relatively short stroke of the valve stem 34. The various parts comprising the valve 1 are interconnected where necessary along threaded connections so that no additional gaskets are required to seal against leakage. Consequently, valve stem stroke stays essentially constant over the life of valve 1. In addition, the valve can be assembled without placing the cap 87 in position. Thereafter, operation of the assembled valve components may be tested. In this way, very accurate settings for valve operation can be attained during valve manufacture merely by adjusting the spring 75 force exerted on the valve stem 34. During such adjustments, malfunctioning components are easily detected.

Numerous variations, within the scope of the appended claims, will be apparent to those skilled in the art in light of the foregoing description and accompanying drawings. Thus, the overall design silhouette of the valve may be varied in other embodiments of this invention. Likewise, the relative size of various components and their locations with respect to one another may be altered. Physical dimensions and designs of the individual components described as preferred may vary in other embodiments of this invention. While the thermostatic responsive means 5 was described as a diaphragm actuated device, other temperature responsive means are compatible with the broader aspects of the invention. These variations are merely illustrative.

Having thus described the invention, what is claimed and desired to be secured by Letters Patent is:

1. A double ported valve, comprising:

an integral, open ended tubular valve body having an axial opening through it, said valve body having an inlet and an outlet communicating with said axial opening, said inlet and said outlet being spaced axially from one another along said valve body;

a cage assembly mounted in said axial opening, said cage assembly having an opening in it coaxial with said axial opening, said cage assembly having a first end and a second end, and means for defining a valve seat at each of said first and said second ends;

a stem mounted for movement through said cage assembly;

a spool assembly mounted to said stem and movable therewith, said spool assembly including a tubular body member having an opening in it, said opening being coaxial with said axial opening, and an enlarged portion having an outer wall defining a valve means for regulating fluid flow through said axial opening along the valve seat of the second end of said cage, the valve means and valve seat of the second cage end delimiting a first valve, said enlarged portion having at least one opening in it communicating with the opening in the body portion of said spool assembly, said spool assembly having an open top defining a valve means for regulating fluid flow through the valve seat at the first end of said cage, the valve means and valve seat of the first cage end delimiting a second valve;

means for exerting a first force tending to open said first and said second valves operatively connected to a first end of said valve stem, said force exerting means closing the first end of said valve body; and stem adjustment means mounted to a second end of said valve body and operatively connected to a second end of said valve stem, said adjustment means including adjustable spring means for exerting a force on said stem tending to close said first and said second valves.

2. The double ported valve of claim 1 wherein said cage has a hub structure at the first end of said cage assembly, said hub passing said shaft, packing in said hub about said shaft, and a plug about said shaft, said plug having at least one indentation in the perimeter thereof, the axially outer end of the hub being staked in the indentation of the plug to hold the packing in position about the shaft.

3. The double ported valve of claim 1 wherein said first force exerting means comprises a power unit including a diaphragm, a first side of said diaphragm being operatively connected to a temperature responsive means, and a second side of said diaphragm being operatively connected to said valve stem.

4. The double ported valve of claim 3 wherein said adjustment means comprises spring guide means mounted to the second end of said valve stem and said spool assembly, a spring having a first end abuting said spring guide and a second end abuting a self threading washer, and a nut including a shank portion having said self threading washer mounted thereon.

5. The double ported valve of claim 4 wherein said adjustment means and said first force exerting means are threadedly mounted to opposite ends of said valve body.

6. A double ported valve, comprising:

a tubular valve body having an axial opening through it;

inlet means mounted to said valve body and communicating with said axial opening;

outlet means mounted to said valve body and communicating with said axial opening, said inlet means and said outlet means being spaced axially from one another along said valve body;

a cage assembly mounted in the axial opening of said valve body in the axial space between said inlet means and said outlet means, said cage assembly having an opening in it, the opening in said cage assembly being coaxial with the axial opening of said valve body, said cage assembly including a first flange, means for sealing said axial opening outboard of said first flange, and means for defining a first valve seat along the axial opening, a second flange, means for sealing said axial opening outboard of said second flange, and means for defining a second valve seat along the axial opening;

a valve stem mounted for movement along said cage assembly, through said first valve seat and said second valve seat;

a spool assembly mounted to said valve stem and movable therewith, said spool assembly including a tubular body member having an opening in it, said opening being coaxial with the axial opening of said valve body, and an enlarged portion having an outer wall defining a valve means for regulating fluid flow through said axial opening along the second valve seat, the valve means and second valve seat delimiting a first valve, said enlarged portion having at least one opening in it communicating with the opening in the body portion of said spool assembly, said spool assembly having an open top defining a valve means for regulating fluid flow through the first valve seat, the last mentioned valve means and first valve seat delimiting a second valve;

means for exerting a first force tending to open said first and said second valves operatively connected to a first end of said valve stem, said force exerting means closing a first end of said valve body; and stem adjustment means mounted to a second end of said valve body, said stem adjustment means being operatively connected to a second end of said valve stem, said adjustment means including spring means for exerting a force on said stem tending to close said first valve and said second valve, and means for adjusting the force exerted by said spring.

7. The double ported valve of claim 6 wherein said cage has a hub structure at the first end of said cage assembly, said hub passing said shaft, packing in said hub about said shaft, and a plug about said shaft, said plug having at least one indentation in the perimeter thereof, the axially outer end of the hub being staked in the indentation of the plug to hold the packing in position about the shaft.

8. The double ported valve of claim 7 wherein said first force exerting means comprises a power unit including a diaphragm, a first side of said diaphragm being operatively connected to a temperature responsive means, and a second side of said diaphragm being operatively connected to said valve stem.

9. The double ported valve of claim 8 wherein said adjustment means comprises spring guide means mounted to the second end of said valve stem and said spool assembly, a spring having a first end abuting said spring guide and a second end abuting a self threading washer, and a nut including a shank portion having said self threading washer mounted thereon.

10. The double ported valve of claim 9 wherein said adjustment means and said first force exerting means are threadedly mounted to opposite ends of said valve body.

* * * * *